United States Patent [19]

Tillotson

[11] Patent Number: 4,487,463

[45] Date of Patent: Dec. 11, 1984

[54] MULTIPLE CONTACT HEADER ASSEMBLY

[75] Inventor: John Tillotson, Southfield, Mich.

[73] Assignee: Gulf & Western Manufacturing Company, Southfield, Mich.

[21] Appl. No.: 468,517

[22] Filed: Feb. 22, 1983

[51] Int. Cl.[3] ..... H01R 9/09

[52] U.S. Cl. ..... 339/17 C; 339/91 R; 339/176 M; 339/218 M

[58] Field of Search ..... 339/218 R, 218 C, 218 L, 339/218 M, 218 S, 17 C, 17 LC, 176 M, DIG. 3, 91 R

[56] References Cited

U.S. PATENT DOCUMENTS

| | | | |
|---|---|---|---|
| 3,950,068 | 4/1976 | Schmieg | 339/176 M |
| 4,243,289 | 1/1981 | Kozel | 339/176 M |

FOREIGN PATENT DOCUMENTS

| | | | |
|---|---|---|---|
| 6509692 | 1/1967 | Netherlands | 339/176 M |
| 932210 | 7/1963 | United Kingdom | 339/17 LC |

*Primary Examiner*—John McQuade
*Attorney, Agent, or Firm*—A. Thomas Kammer

[57] ABSTRACT

A header assembly is provided for the electrical connection of printed circuit boards to cables or other boards. The assembly includes an insulator having an array of male pin members mounted thereto. Each pin member comprises a plastic post to which a pair of electrical contacts is secured.

13 Claims, 5 Drawing Figures

FIG.4

FIG.1
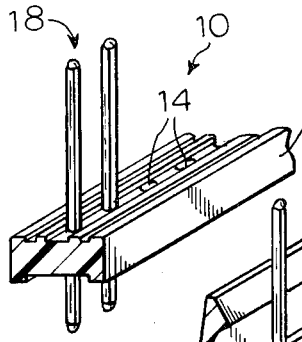
FIG.2
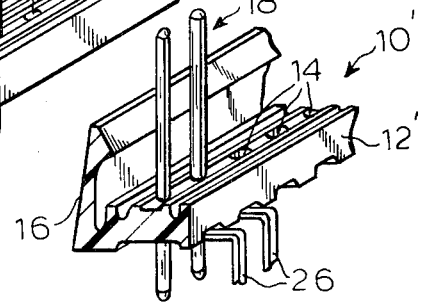
FIG.3
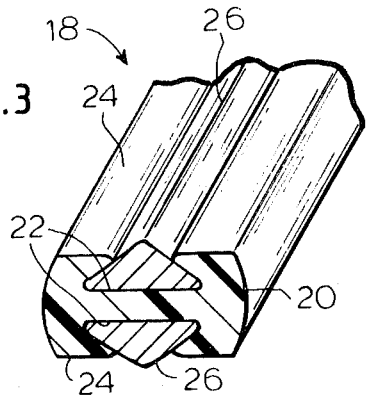
FIG.4
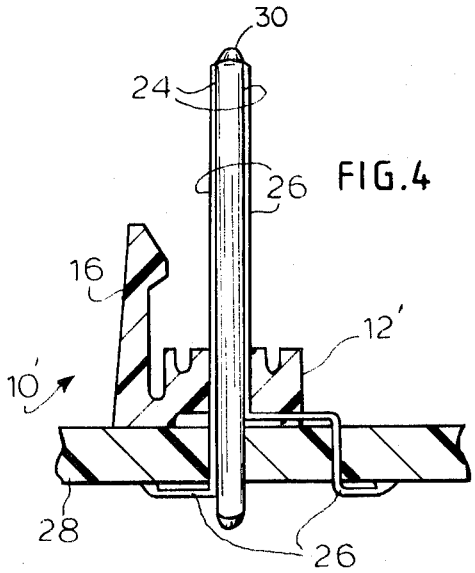
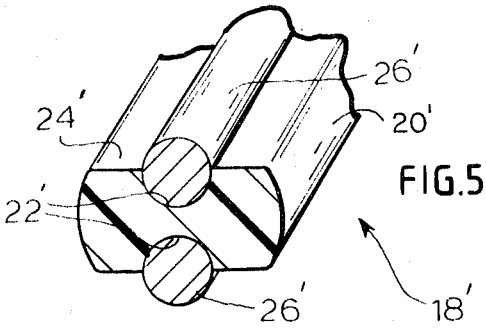
FIG.5

MULTIPLE CONTACT HEADER ASSEMBLY

BACKGROUND OF THE INVENTION

1. Field of the Invention

The field of the invention relates to connector printed circuit board header assemblies.

2. Brief Description of the Prior Art

Connector printed circuit board header assemblies are commonly employed for connecting printed circuit boards to other boards or cables. A high density array of male pins are mounted to an insulator along a selected center or centers. Typical distances between the centers of each pin are 0.100, 0.125, 0.156, and 0.200 inches. The pins are typically square or rectangular in shape and are of integral construction. Typical materials employed for the insulator include diallyl phthalate, polycarbonate, certain polyesters and nylons.

The pins may project from both sides of an insulator. One set of pin ends may then project through a set of corresponding apertures in a printed circuit board. In situations where it has been desirable to have the same signal on both sides of the board, plated through apertures have been provided.

SUMMARY OF THE INVENTION

A header assembly is provided which allows one to reduce the density of interconnections required to perform a given function. The assembly includes an insulator and a plurality of pin members mounted thereto. The pin members include a dielectric member to which a plurality of contacts are mounted. The contacts are separated from each other by the dielectric material. Each has an exposed surface capable of making electrical contact with an appropriately designed receptacle.

By providing pin members having a plurality of isolated contacts, a number of advantages are realized. As mentioned above, the density of interconnections may be reduced. For example, if a 0.156 inch centerline mass termination receptacle is employed, the density of interconnecting may be cut in half with a header assembly having two contacts per pin member. Alternatively, an assembly having a 0.100 inch centerline could be replaced with a more durable product on 0.156 inch centers and still have a savings in printed circuit board space.

BRIEF DESCRIPTION OF THE DRAWINGS

FIG. 1 is a perspective view of a first header assembly according to the invention;

FIG. 2 is a perspective view of a second header assembly according to the invention;

FIG. 3 is an enlarged partially sectional perspective view of a pin member for either of said header assemblies;

FIG. 4 is an enlarged sectional side elevation view of the header assembly shown in FIG. 2 as mounted to a printed circuit board; and FIG. 5 is a partially sectional perspective view of a pin member having a pair of opposing cylindrical contacts.

DETAILED DESCRIPTION OF THE INVENTION

A header assembly is provided including a plurality of male pins mounted to an insulator. Depending upon the intended function of the assembly, it may resemble the embodiments shown in FIG. 1 or FIG. 2.

The header assembly 10 of FIG. 1 includes an insulator 12 having a plurality of apertures 14 therein. The assembly 10' shown in FIG. 2 includes a combined insulator/locking latch 12'. The insulator portion thereof has a plurality of apertures 14 therein. The latch portion 16 allows the assembly to be secured to a female connector (not shown) having means for engaging it.

Both embodiments discussed above include a plurality of pin members 18 positioned within the respective apertures 14. The axes of each aperture are spaced a selected uniform distance from each other. A distance of 0.156 inches is typical but by no means exclusive. The diameters of these apertures may be on the order of about 0.07 inches.

The pin members 18 or 18' are positioned within the apertures to form a row. Only two pin members are shown in each of FIGS. 1 and 2, but those skilled in the art will appreciate that the assembly may include many such members. FIGS. 3 and 5 illustrate two different pin members 18, 18' in greater detail. Each includes a plastic post 20, 20' having a generally rectangular cross section. A pair of wedge-shaped or ovalized longitudinal grooves 22, 22' are defined in the opposing larger sides 24, 24' of the post. A metal contact 26 or 26' having a triangular or cirular cross-section is positioned within each of the grooves 22 or 22'. The contacts 26,26' may be made from brass or other known copper base or copper clad alloys. They are electrically insulated from each other by means of the post.

A portion of each contact projects beyond the respective planes defined by the larger sides 24 of the post 20. They will accordingly contact the interior surfaces of a corresponding female receptacle.

In order to allow the contacts to bend near one end of the post, the grooves 22 need not extend the entire length thereof. There will accordingly be no restriction of movement or possible damage when at least one of the contacts is bent perpendicularly as shown in FIG. 2. One possible manufacturing technique would be to extrude a pair of wires with the plastic post. If the tolerances do not permit extrusion, a molding process may be employed. Another alternative would be to plate the entire plastic post with a metal and then remove selected portions thereof by abrasion.

The assembly 10' is mounted to a printed circuit board 28 as shown in FIG. 4. One of the contacts can be soldered to the top side of the board or can be formed to enter an additonal hole in the printed circuit board for wave soldering purposes. After the pin member 18 is inserted through a hole in the board, the other contact 26 is bent perpendicularly and soldered to the opposite side thereof. To facilitate bending, one or both contacts may project beyond one end of the post 20. The opposite end 30 of the post extends beyond the contacts 26.

To use the header assemblies of the present invention to advantage, they should be mated to female connector assemblies having isolated connections on each side of each receptacle. If, for example, a cable to board connection were desired, the female connector would have two isolated halves, each having its own cable connection and/or termination means. One half of each pin member receptacle would be connected to one cable connection, the other to the second cable connection. The pin member contacts 26 engage the opposite walls of the receptacles.

Due to the small size of the contacts 26, the header assemblies provided herein are most suitable for low current applications. The rectangular shape of the plastic pin member 18 provides sufficient strength without requiring excessive space.

What is claimed is:

1. A header assembly for electrical connections comprising:

an insulator, a plurality of pin members mounted to and projecting from said insulator, at least one of said pin members including first and second longitudinal electrical contacts separated by a contact insulator, said contact insulator comprising a longitudinal post having a first end, a second end, and first and second longitudinal grooves running along the exterior surface of said post at least part of the distance between said first and second ends, said first contact being positioned within said first groove and said second contact being positioned within said second groove, each of said contacts including a longitudinal surface projecting beyond the exterior surface of said post, at least one of said contacts being bendable away from the axis of said post near an end thereof.

2. A header assembly as defined in claim 1 wherein said contacts are secured longitudinally along opposite longitudinal sides of said post.

3. A header assembly as defined in claim 1 wherein each of said contacts has a triangular cross section.

4. A header assembly as defined in claim 1 wherein each of said contacts has a circular cross section.

5. A header assembly as defined in claim 1 wherein at least one of said contacts has two perpendicular bends therein for the purpose of establishing spacing to go through a printed circuit board.

6. A header assembly as defined in claim 1 wherein said insulator is mounted to a printed circuit board.

7. A header assembly as defined in claim 6 wherein said pin members extend through said printed circuit board.

8. A header assembly as defined in claim 1 wherein said insulator includes an integral latch portion.

9. A header assembly as defined in claim 1 wherein at least one of said contacts extends beyond an end of said post.

10. A header assembly as defined in claim 1 wherein said post includes an end extending longitudinally further than said contacts.

11. A header assembly as defined in claim 3 wherein the shapes of said grooves correspond to the shapes of said contacts.

12. A header assembly as defined in claim 1 wherein each of said pin members is substantially rectangular in cross section.

13. A header assembly as defined in claim 1 wherein said longitudinal post is made from a dielectric material.

* * * * *